US009431745B2

(12) United States Patent
Kurono et al.

(10) Patent No.: US 9,431,745 B2
(45) Date of Patent: Aug. 30, 2016

(54) CONNECTOR WITH TERMINAL LOCKING FUNCTION

(71) Applicants: Toyota Jidosha Kabushiki Kaisha, Toyota-shi Aichi-ken (JP); Sumitomo Wiring Systems, Ltd., Yokkaichi, Mie (JP)

(72) Inventors: Yosuke Kurono, Miyoshi (JP); Toshiki Muramatsu, Iida (JP); Naomichi Kawashima, Yokkaichi (JP)

(73) Assignees: Toyota Jidosha Kabushiki Kaisha, Toyota-shi (JP); Sumitomo Wiring Systems, Ltd., Yokkaichi-shi (JP)

( * ) Notice: Subject to any disclaimer, the term of this patent is extended or adjusted under 35 U.S.C. 154(b) by 0 days.

(21) Appl. No.: 14/468,949

(22) Filed: Aug. 26, 2014

(65) Prior Publication Data

US 2015/0064988 A1 Mar. 5, 2015

(30) Foreign Application Priority Data

Aug. 28, 2013 (JP) ..... 2013-176421

(51) Int. Cl.
*H01R 13/514* (2006.01)
*H01R 13/436* (2006.01)

(52) U.S. Cl.
CPC ..... *H01R 13/4362* (2013.01)

(58) Field of Classification Search
CPC ..... H01R 13/4361; H01R 13/4362; H01R 13/4365; H01R 13/4368; H01R 13/4223
USPC ..... 439/736–752, 733.1
See application file for complete search history.

(56) References Cited

U.S. PATENT DOCUMENTS 6,010,374 A * 1/2000 Miwa ..... 439/752
6,116,954 A * 9/2000 Ries ..... H01R 13/506 439/423
6,402,573 B1 * 6/2002 Yeomans ..... H01R 13/4362 439/752
6,648,699 B1 * 11/2003 Makino et al. ..... 439/752
2004/0175985 A1 * 9/2004 Takahashi ..... H01R 31/085 439/507
2007/0093131 A1 * 4/2007 Takahashi et al. ..... 439/595
2008/0119091 A1 * 5/2008 Nishide ..... H01R 13/4362 439/733.1
2008/0305694 A1 * 12/2008 Takahashi et al. ..... 439/752

(Continued)

FOREIGN PATENT DOCUMENTS

JP 2003-151672 A 5/2003
JP 2008-130311 A 6/2008

(Continued)

*Primary Examiner* — Tulsidas C Patel
*Assistant Examiner* — Peter G Leigh
(74) *Attorney, Agent, or Firm* — Dinsmore & Shohl LLP

(57) ABSTRACT

A connector includes a plurality of terminals, a housing, and a retainer. The housing includes terminal housing chambers and partition portions. Each of the terminal housing chambers accommodates therein each of the plurality of terminals. Each of the partition portions is provided between adjacent terminal housing chambers and partition the adjacent terminal housing chambers from each other. The retainer is attached to the housing. The retainer is configured to prevent each of the terminals from falling out and to move between a temporary locking position and a proper locking position. The retainer includes communication cut portions. While the retainer is moving between the proper locking position and the temporary locking position, each of the communication cut portions is kept in contact with its corresponding partition portion and cut off communication between the adjacent terminal housing chambers.

3 Claims, 3 Drawing Sheets

(56) References Cited

U.S. PATENT DOCUMENTS

| | | | | |
|---|---|---|---|---|
| 2009/0298353 | A1* | 12/2009 | Kojima | 439/752 |
| 2010/0068911 | A1* | 3/2010 | Nagano et al. | 439/345 |
| 2011/0183551 | A1* | 7/2011 | Hirano | 439/752 |
| 2011/0212655 | A1* | 9/2011 | Hemmi et al. | 439/752 |
| 2012/0214358 | A1* | 8/2012 | Takahashi et al. | 439/865 |
| 2014/0120762 | A1* | 5/2014 | Kuroda | 439/370 |
| 2015/0031250 | A1* | 1/2015 | Kitajima et al. | 439/733.1 |

FOREIGN PATENT DOCUMENTS

| | | | |
|---|---|---|---|
| JP | 2011-165370 | A | 8/2011 |
| JP | 2012-119194 | A | 6/2012 |
| JP | 2013-055010 | A | 3/2013 |

* cited by examiner

CONNECTOR WITH TERMINAL LOCKING FUNCTION

INCORPORATION BY REFERENCE

The disclosure of Japanese Patent Application No. 2013-476421 filed on Aug. 28, 2013 including the specification, drawings and abstract is incorporated herein by reference in its entirety.

BACKGROUND OF THE INVENTION

1. Field of the Invention

The present invention relates to a connector, particularly to improvement of a structure of a connector including a retainer configured to prevent a terminal from falling out of a housing.

2. Description of Related Art

Japanese Patent Application Publication No. 2012-119194 (JP 2012-119194 A) describes a connector configured such that a terminal is inserted to a housing, and a retainer is attached to the housing from a direction intersecting with an insertion direction of the terminal so as to lock the retainer to the terminal, thereby preventing the terminal from falling out of the housing.

When the terminal is inserted into the housing, the retainer is attached to the housing such that the retainer is retreated to a temporary locking position in which the retainer allows the terminal to be removed from or inserted into the housing. Then, after the terminal is inserted into the housing, the retainer is moved to a proper locking position in which the retainer makes closer contact with the housing than in the temporary locking position, and the retainer is attached to the housing so as to be locked to the terminal. The retainer is locked to the terminal in the proper locking position, and hereby, the terminal is prevented from falling out of the housing.

SUMMARY OF THE INVENTION

In the connector described above, in a case where there is a plurality of terminals to be inserted into the housing, terminal housing chambers each configured to accommodate each of the terminals therein are formed. When the retainer is placed in the temporary locking position, the retainer is separated from the housing in comparison with a case where the retainer is placed in the proper locking position, so that those parts of the retainer which partition adjacent terminal housing chambers from each other are separated from the housing. This causes the adjacent terminal housing chambers to communicate with each other. In a case where assembly, attachment, wiring, or the like operation is performed in such a state where the terminal housing chambers communicate with each other, metal foreign substances invade into the terminal housing chambers, which may cause short circuit between the terminals via the metal foreign substances thus invading.

An object of the present invention is to provide a connector configured such that, at the time when a retainer is placed in a temporary locking position, even when metal foreign substances invade into a housing, the connector is able to surely prevent short circuit between terminals.

In one aspect of the present invention, a connector includes a plurality of terminals, a housing, and a retainer. The housing includes terminal housing chambers and partition portions. Each of the terminal housing chambers is configured to accommodate therein each of the plurality of terminals. Each of the partition portions is provided between adjacent terminal housing chambers and partition the adjacent terminal housing chambers from each other. The retainer is attached to the housing. The retainer is configured to prevent each of the terminals from falling out and to move between a temporary locking position and a proper locking position. The temporary locking position is a position in which the retainer allows the terminals to be inserted into or removed from the housing. The proper locking position is a position in which the retainer makes closer contact with the housing than in the temporary locking position and the retainer is locked to the terminals so as to prevent the terminals from falling off. The retainer includes communication cut portions. While the retainer is moving between the proper locking position and the temporary locking position, each of the communication cut portions is kept in contact with its corresponding partition portion and cut off communication between the adjacent terminal housing chambers.

In the above aspect, the connector may be configured such that one of the partition portion and the communication cut portion includes a projecting portion, and the other one of them includes a groove. Even when the retainer is placed in the temporary locking position, the projecting portion and the groove are at least partially fitted to each other. When the retainer is placed in the proper locking position, the projecting portion is fitted to the groove.

According to the connector of the present invention, at the time when the retainer is placed in the temporary locking position, even if metal foreign substances invade into the housing, the connector is able to surely prevent short circuit between the terminals.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
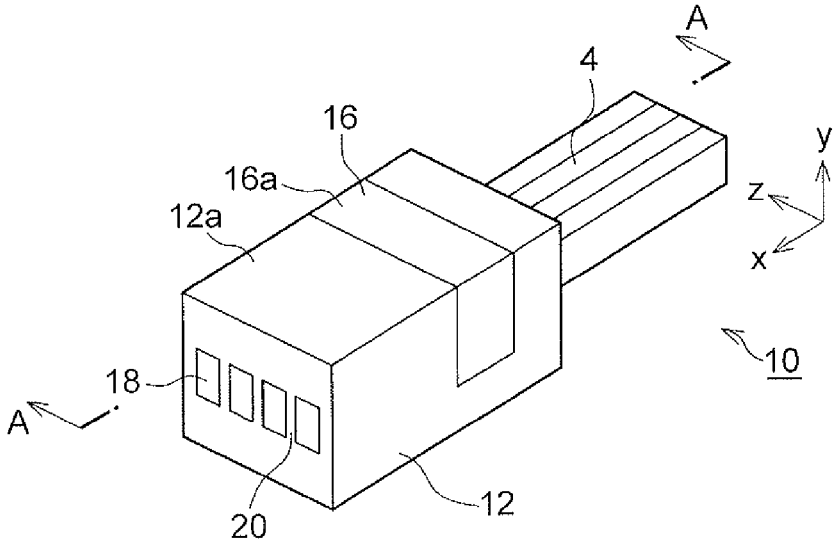
FIG. 1 is a perspective view illustrating a configuration of a connector according to the present embodiment.
Figure 2:
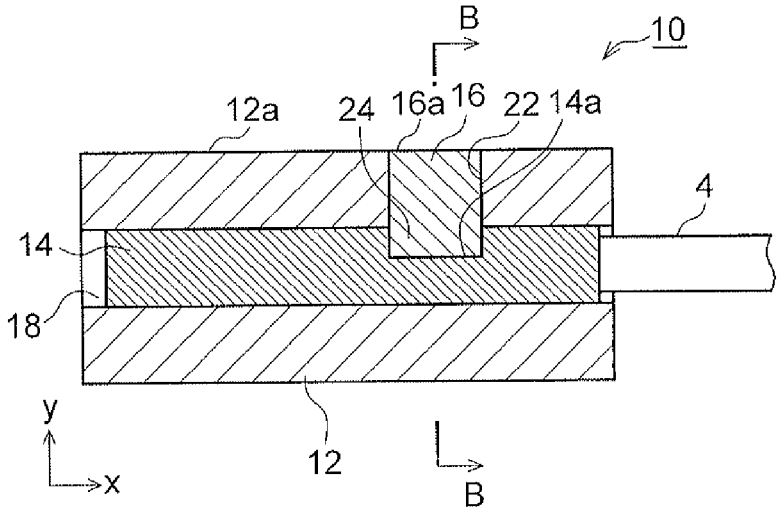
FIG. 2 is a sectional view of the connector taken along a line A-A in FIG. 1.

An embodiment of a connector according to the present invention will be described below with reference to the drawings. FIG. 1 is a perspective view illustrating a configuration of a connector according to the present embodiment, and FIG. 2 is a sectional view of the connector taken along a line A-A in FIG. 1. More specifically, FIG. 2 is a sectional view of the connector taken along a flat surface xy, and viewed in a z-direction.

The connector 10 includes: a housing 12; a plurality of terminals 14 inserted into the housing 12; and a retainer 16 attached to the housing 12.

In the figure, an insertion-removal direction of the terminals 14 with respect to the housing 12 is indicated by a reference sign x, an insertion-removal direction of the retainer 16 with respect to the housing 12 is indicated by a reference sign y, and a direction perpendicular to the x-direction and the y-direction is indicated by a reference sign z. The present embodiment deals with a case where the y-direction is perpendicular to the x-direction. However, the present invention is not limited to the configuration, and the y-direction may be a direction that merely intersects with the x-direction.

The housing 12 is made of a material having insulating properties, e.g., synthetic resin, and terminal housing chambers 18 in which to accommodate respective terminals 14 are formed in the housing 12. The terminal housing chambers 18 are separated from each other by partition walls 20, and are arranged in line in the z-direction. The terminal housing chambers 18 are formed so as to penetrate through the housing 12 in the x-direction.

Further, the housing 12 has a retainer opening 22 in which the retainer 16 is mounted. The retainer opening 22 is opened toward an upper side (upward in FIG. 2) of the housing 12 and toward both sides (outer sides in the z-direction) of the housing 12. The retainer opening 22 is formed so as to penetrate through the terminal housing chambers 18 from a top surface 12*a* of the housing 12, and the retainer 16 is attachable and detachable thereto from the upper side of the housing 12. In a region of the retainer opening 22, the partition walls 20 of the housing 12 are cut out due to the retainer opening 22, so that all the terminal housing chambers 18 communicate with each other.

The terminal 14 is made of an electrically-conductive material, e.g., copper, and is formed in an elongated shape in the x-direction, e.g., a square tubular shape. A tab (not shown) of a counterpart terminal is inserted into a tip (a left end in FIG. 2) of the terminal 14 so that the tab is electrically connected to the terminal 14. On the other hand, a lead wire is connected to a base end (a right end of FIG. 2) of the terminal 14 by contact bonding.

The retainer 16 is made of a material having insulating properties, e.g., synthetic resin, and is formed in a generally rectangular solid having a long side in the z-direction. The retainer 16 is inserted into the retainer opening 22 from the upper side of the housing 12, so as to be attached to the housing 12. The retainer 16 attached to the housing 12 is kept in either of a proper locking position and a temporary locking position, and is movable in the y-direction between the proper locking position and the temporary locking position.

In the proper locking position, part of the retainer 16 is locked to a hollow portion 14*a* of the terminal 14, so as to regulate a movement of the terminal 14 in the x-direction, as illustrated in FIG. 2. This makes it possible to prevent the terminal 14 from falling out of the housing 12. Hereinafter, that part of the retainer 16 which is locked to the hollow portion 14*a* is referred to as a locking portion 24. Further, in the proper locking position, the retainer 16 is attached to the housing 12 so that a top surface 16*a* of the retainer 16 is placed on the same flat surface as a top surface 12*a* of the housing 12, as illustrated in FIGS. 1, 2.

In the meantime, in the temporary locking position, the retainer 16 is placed on an upper side relative to the proper locking position, so that the locking portion 24 is removed from the hollow portion 14*a* and the terminal 14 is movable in the x-direction. That is, the terminal 14 is insertable into or removable from the housing 12.

In the connector 10 of the present embodiment, the housing 12 includes partition portions 26 (illustrated in FIGS. 3, 4) that partition the terminal housing chambers 18 from each other. The partition portions 26 are provided between the terminal housing chambers 18 adjacent to each other. While the retainer 16 moves between the proper locking position and the temporary locking position, the retainer 16 keeps in contact with the partition portions 26. Further, the retainer 16 includes communication cut portions 28 (illustrated in FIGS. 3, 4) each configured to cut off communication between the terminal housing chambers 18 adjacent to each other. Even when the retainer 16 is placed in the temporary locking position, the communication cut portion 28 is configured to keep in contact with the partition portion 26. With such a configuration, it is possible to always partition the terminal housing chambers 18 from each other. As a result, even when metal foreign substances invade into the housing 12 at the time of assembly, attachment, wiring, or the like operation performed in the temporary locking position, it is possible to surely prevent short circuit due to the foreign substances between the terminals 14.

Figure 3:
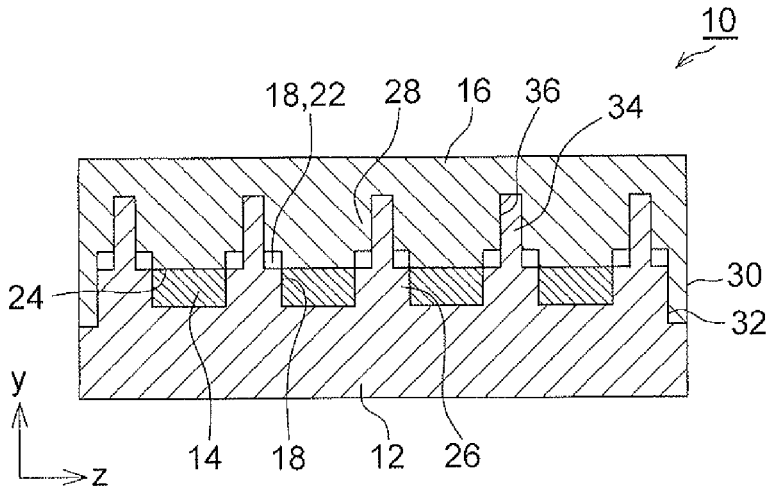
FIG. 3 is a sectional view of the connector taken along a line B-B in FIG. 2, at the time when a retainer is placed in a proper locking position.
Figure 4:
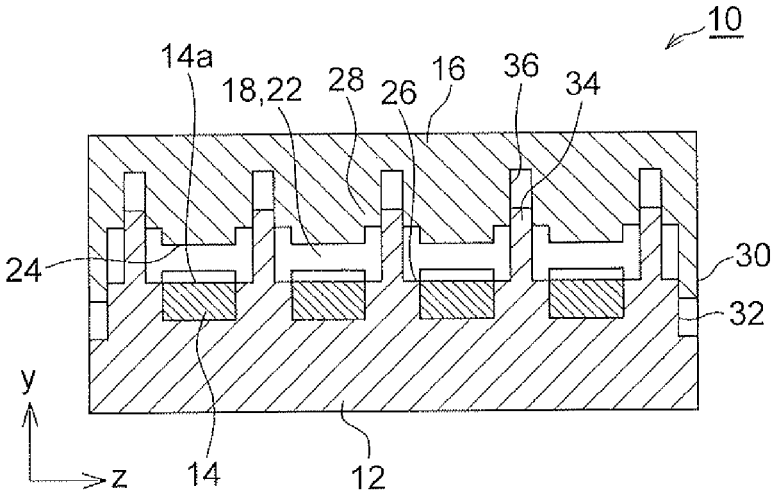
FIG. 4 is a sectional view of the connector taken along the line B-B in FIG. 2, at the time when the retainer is placed in a temporary locking position.

Next, a detailed configuration of the connector 10 of the present embodiment in a region of the retainer opening 22 will be described with reference to FIGS. 3, 4. FIG. 3 is a sectional view of the connector 10 taken along a line B-B in FIG. 2, at the time when the retainer 16 is placed in the proper locking position. FIG. 4 is a sectional view of the connector 10 taken along the line B-B in FIG. 2, at the time when the retainer 16 is placed in the temporary locking position.

A locking fitting portion 32 is formed on either side surface of the housing 10 in the z-direction so that the after-mentioned side locking portion 30 of the retainer 16 is fitted therein in a slidable manner. The locking fitting portion 32 is a portion formed by partially denting a side surface of the housing 12, and is continued into the retainer opening 22. Although not illustrated herein, the locking fitting portion 32 is provided with a temporary locking projection and a proper locking project each projecting from a surface thereof. The proper locking projection is placed below the temporary locking projection (on a lower side in FIG. 3).

The side locking portion 30 to be fitted to the locking fitting portion 32 of the housing 10 is formed on either side surface of the retainer 16 in the z-direction. The side locking portion 30 has a plate-like shape hanging down from a main body of the retainer 16. A locking hollow portion (not shown) is formed on an inner side surface of the side locking portion 30, so as to be lockable to the temporary locking projection or the proper locking projection of the locking fitting portion 32. When the locking hollow portion is locked to the temporary locking projection, the retainer 16 is kept in the temporary locking position (a state of FIG. 4), and when the locking hollow portion is locked to the proper locking projection, the retainer 16 is kept in the proper locking position (a state of FIG. 3).

Further, the housing 10 is provided with the terminal housing chambers 18 in which to accommodate the terminals 14, so that the terminal housing chambers 18 are formed at predetermined intervals in the z-direction. The partition portion 26 is provided between adjacent terminal housing chambers 18 so as to separate the adjacent terminal housing chambers 18 from each other. The partition portion 26 constitutes part of the partition wall 20 (illustrated in FIG. 3) that is cut out due to the retainer opening 22. Since the partition walls 20 are cut out as such, all the terminal housing chambers 18 communicate with each other. Further, the partition portions 26 are provided on outer sides of the terminal housing chambers 18 provided on respective outermost sides in the z direction, so as to separate these chambers 18 from outside.

The partition portion 26 of the present embodiment includes a projecting portion 34 projecting toward the retainer 16, that is, toward an upper side of the housing 10. The projecting portion 34 is formed so as to be fitted to the after-mentioned groove 36. The retainer 16 of the present embodiment includes, in a position opposed to the partition portions 26 of the housing 10, the communication cut portions 28 making contact with the partition portions 26 so as to cut off communication between the terminal housing chambers 18. The communication cut portion 28 includes the groove 36 formed so that the projecting portion 34 of the partition portion 26 is fitted thereto.

As illustrated in FIG. 3, the projecting portion 34 and the groove 36 are formed so as to be completely fitted to each other at the time when the retainer 16 is placed in the proper locking position. Further, as illustrated in FIG. 4, the projecting portion 34 and the groove 36 are formed so as to be partially fitted to each other even when the retainer 16 is placed in the temporary locking position. More specifically, the projecting portion 34 and the groove 36 are formed so as to have at least a length corresponding to a distance between the proper locking position and the temporary locking position in the y-direction. According to such a configuration, when the retainer 16 is placed in the proper locking position, the projecting portion 34 and the groove 36 are fitted to each other so as to keep in contact with each other; and when the retainer 16 is placed in the temporary locking position, the projecting portion 34 and the groove 36 are partially fitted to each other so as to keep in contact with each other. Further, even when the retainer 16 is moving between the proper locking position and the temporary locking position, the projecting portion 34 and the groove 36 are at least partially fitted to each other so as to keep in contact with each other.

According to such a configuration of the projecting portion 34 and the groove 36, even when the retainer 16 is placed in the temporary locking position, it is possible to always partition the terminal housing chambers 18 from each other, as illustrated in FIG. 4. As a result, even when metal foreign substances invade into the housing 12 at the time of assembly, attachment, wiring, or the like operation performed in the temporary locking position, it is possible to surely prevent short circuit due to the foreign substances between the terminals 14.

The present embodiment deals with a case where the projecting portion 34 is formed in the partition portion 26 of the housing 12 and the groove 36 is formed in the communication cut portion 28 of the retainer 16. However, the present invention is not limited to the configuration. The present invention may be configured such that the projecting portion 34 is formed in one of the partition portion 26 and the communication cut portion 28, and the groove 36 is formed in the other one of them.

Figure 5:
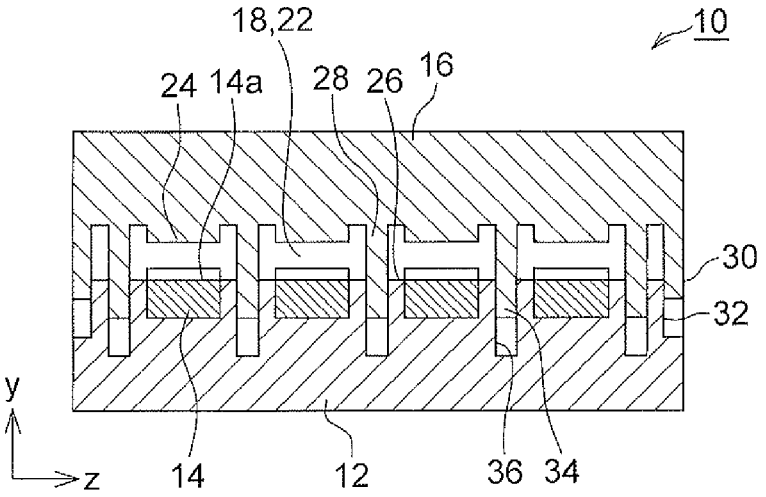
FIG. 5 is a sectional view of a connector according to another embodiment, at the time when a retainer is placed in a temporary locking position.

FIG. 5 is a sectional view of a connector 10 according to another embodiment, at the time when a retainer 16 is placed in a temporary locking position. In this figure, a groove 36 is formed in a partition portion 26 and a projecting portion 34 is formed in a communication cut portion 28. Similarly to FIG. 3, the projecting portion 34 and the groove 36 are formed so as to be completely fitted to each other at the time when the retainer 16 is placed in a proper locking position. In the meantime, as illustrated in FIG. 5, the projecting portion 34 and the groove 36 are formed so as to be partially fitted to each other at the time when the retainer 16 is placed in the temporary locking position. More specifically, the projecting portion 34 and the groove 36 are formed so as to have at least a length corresponding to a distance between the proper locking position and the temporary locking position in the y-direction.

According to such a configuration of the projecting portion 34 and the groove 36, even when the retainer 16 is placed in the temporary locking position, it is possible to partition terminal housing chambers 18 from each other, as illustrated in FIG. 5. As a result, even when metal foreign substances invade into a housing 12 at the time of assembly, attachment, wiring, or the like operation performed in the temporary locking position, it is possible to surely prevent short circuit due to the foreign substances between terminals 14.

Further, the above embodiment deals with a case where the projecting portion 34 and the groove 36 are formed so as to be at least partially fitted to each other to partition the terminal housing chambers 18 from each other at the time when the retainer 16 is placed in the temporary locking position. However, the present invention is not limited to the configuration. If the partition portion 26 and the communication cut portion 28 are configured to keep in contact with each other even when the retainer 16 is placed in the temporary locking position, it is not necessary to provide the projecting portion 34 and the groove 36. The following describes a configuration of the partition portion 26 and communication cut portion 28 in such an aspect, with reference to FIG. 6.

Figure 6:
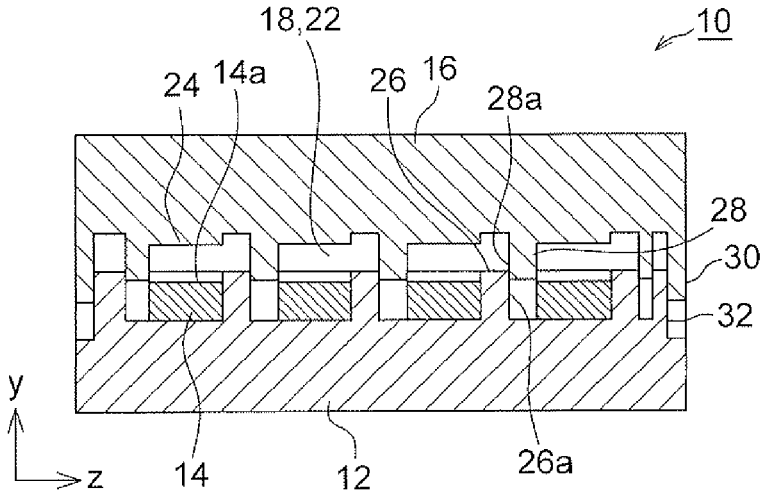
FIG. 6 is a sectional view of a connector according to another embodiment, at the time when a retainer is placed in a temporary locking position.

FIG. 6 is a sectional view of a connector 10 according to another embodiment, at the time when a retainer 16 is placed in a temporary locking position. As illustrated in FIG. 6, a partition portion 26 and a communication cut portion 28 are configured to make contact with each other so as to keep such a contact state, even when the retainer 16 is placed in the temporary locking position. More specifically, a side surface 26*a* of the partition portion 26 is opposed to a side surface 28*a* of the communication cut portion 28, so that the side surfaces 26*a*, 28*a* make contact with each other. The side surfaces 26*a*, 28*a* are formed so as to have at least a length corresponding to a distance between a proper locking position and the temporary locking position along the y-direction. Accordingly, although not illustrated herein, when the retainer 16 is placed in the proper locking position, the side surfaces 26*a*, 28*a* also make contact with each other, so as to keep such a contact state. Further, even if the retainer 16 is moving between the proper locking position and the temporary locking position, the side surface 26*a* of the partition portion 26 and the side surface 28*a* of the communication cut portion 28 at least partially make contact with each other, so as to keep such a contact state.

According to such a configuration of the partition portion 26 and the communication cut portion 28, even when the retainer 16 is placed in the temporary locking position, it is possible to partition terminal housing chambers 18 from each other, as illustrated in FIG. 6. As a result, even if metal foreign substances invade into a housing 12 at the time of assembly, attachment, wiring, or the like operation performed in the temporary locking position, it is possible to surely prevent short circuit due to the foreign substances between terminals 14.

The above embodiment deals with a case where part of the partition portion 26 and part of the communication cut portion 28 are formed along the y direction, so as to make contact with each other. However, the present invention is not limited to the configuration. If the terminal housing chambers 18 can be partitioned from each other between the proper locking position and the temporary locking position, those parts of the partition portion 26 and the communication cut portion 28 which make contact with each other may be formed diagonally with respect to the y-direction. For example, the projecting portion 34 may be formed as a projection having a V-shaped section, and the groove 36 may be formed as a groove having a V-shaped section so as to be fitted to the projecting portion 34.

What is claimed is:

1. A connector comprising:

a plurality of terminals;

a housing including terminal housing chambers and partition portions, each of the terminal housing chambers being configured to accommodate each of the plurality of terminals, each of the partition portions being provided between adjacent terminal housing chambers and each of the partition portions being configured to partition the adjacent terminal housing chambers from each other; and a retainer attached to the housing, the retainer including a top surface and a bottom surface opposite the top surface of the retainer, the retainer being configured to prevent each of the terminals from falling out and to move between a temporary locking position and a proper locking position, the retainer including communication cut portions extending from the bottom surface of the retainer, each of the communication cut portions being kept in contact with its corresponding partition portion and cutting off communication between the adjacent terminal housing chambers, while the retainer is moving between the proper locking position and the temporary locking position, the temporary locking position being a position in which the retainer allows the terminals to be inserted into or removed from the housing, and the proper locking position being a position in which the retainer makes closer contact with the housing than in the temporary locking position and the retainer is locked to the terminals so as to prevent the terminals from falling off.

2. The connector according to claim 1, wherein:

one of the partition portion and the communication cut portion includes a projecting portion, and the other one of the partition portion and the communication cut portion includes a groove;

even when the retainer is placed in the temporary locking position, the projecting portion and the groove are at least partially fitted to each other; and when the retainer is placed in the proper locking position, the projecting portion is fitted to the groove.

3. A connector comprising:

a plurality of terminals;

a housing including a top surface, terminal housing chambers and partition portions, each of the terminal housing chambers being configured to accommodate each of the plurality of terminals, each of the partition portions being provided between adjacent terminal housing chambers and each of the partition portions being configured to partition the adjacent terminal housing chambers from each other; and a retainer attached to the housing, the retainer including a top surface and a bottom surface opposite the top surface of the retainer, the retainer being configured to prevent each of the terminals from falling out and to move between a temporary locking position and a proper locking position, the retainer including communication cut portions extending from the bottom surface of the retainer, each of the communication cut portions being kept in contact with its corresponding partition portion and cutting off communication between the adjacent terminal housing chambers, while the retainer is moving between the proper locking position and the temporary locking position, the temporary locking position being a position in which the retainer allows the terminals to be inserted into or removed from the housing, and the proper locking position being a position in which the retainer makes closer contact with the housing than in the temporary locking position, the top surface of the retainer extends flush with the top surface of the housing, and the retainer is locked to the terminals so as to prevent the terminals from falling off.

* * * * *